US005301732A

United States Patent [19]

Aabel

[11] Patent Number: 5,301,732

[45] Date of Patent: Apr. 12, 1994

[54] DOOR

[75] Inventor: Lasse Aabel, Drammen, Norway

[73] Assignee: Nomafa AB, Sweden

[21] Appl. No.: 913,178

[22] Filed: Jul. 14, 1992

[51] Int. Cl.[5] ..... E06B 9/06

[52] U.S. Cl. ..... 160/84.1 E; 160/84.1 R; 160/193

[58] Field of Search ..... 160/84.1, 222, 193, 160/201, 202, 205, 37; 52/64, 71, 645

[56] References Cited

U.S. PATENT DOCUMENTS

| | | | |
|---|---|---|---|
| 2,339,570 | 1/1944 | Jackson | 160/37 X |
| 3,429,298 | 2/1969 | Thomason | 160/84.1 X |
| 4,194,549 | 3/1980 | Lovgren | 160/84.1 |

FOREIGN PATENT DOCUMENTS

| | | | |
|---|---|---|---|
| 303647 | 2/1918 | Fed. Rep. of Germany | 160/193 |

*Primary Examiner*—Blair M. Johnson

[57] ABSTRACT

A door, particularly for large doorways, which includes a door leaf suspended from an upper edge of the doorway and including at least one of a continuous sheet or a number of sheets arranged in a single or several layers attached to a series of lateral braces at an equal or common distance from each other in a vertical direction of the doorway. The lateral braces extend at respective ends thereof into a generally vertically extending guide profile, and from an upper edge of the doorway, a hoist is provided which includes lines or belts. Each lateral brace includes an attached hoisting device, with the hoisting devices being connected so as to enable movement of the door in an upward and downward direction.

5 Claims, 4 Drawing Sheets

DOOR

FIELD OF THE INVENTION

The present invention relates to a door and, more particularly, to a door for large doorways including a door leaf suspended from an upper edge of the doorway, with the doorleaf comprising one or several pieces of fabric or a continuous sheet in one of a single or several layers attached to a series of lateral braces at a common distance from each other in a vertical direction of the doorway, with each end being controlled in a vertical direction in a vertical guide profile, and where from an upper edge of the doorway, a hoisting means is connected to a hoisting device in a downward direction for attachment to each lateral brace.

BACKGROUND OF THE INVENTION

In various connections there is a need for a door that can cover large openings, with the door being lightweight, simple in construction and inexpensive to manufacture.

Norwegian Patent 136,110 describes a door that has a hoisting wire for raising the door which is fed through the separate lateral braces and fastened to a lowermost lateral brace. When this door is raised, the first lateral brace is initially raised while the rest of the door is motionless until the lateral braces below are raised toward the upper lateral brace thereby resulting in the lateral braces being forced together and squeezing the fabric of the door therebetween causing a number of problems. In the closed position the individual lateral braces will load the fabric and thereby stretch the same and there is a general need to improve this existing type of door.

SUMMARY OF THE INVENTION

The aim underlying the present invention essentially resides in providing a door of the aforementioned type which is not as detrimental to the fabric in the door, and, in particular, avoids squeezing the fabric when the door is raised and opened.

In accordance with the present invention, a hoisting system is provided that avoids using the fabric in the door as a supportive element and eliminates squeezing the fabric between the various lateral braces.

In accordance with still further features of the present invention, the loading of the hoisting unit is reduced so that the height of the opening can be as large as required.

According to features of the present invention, it is possible to avoid excessive loading of the fabric when the lateral braces are in an open position.

In accordance with the present invention a door, particularly for large doorways, includes a doorleaf that is suspended from an upper edge of the doorway and comprises pieces of fabric or a continuous sheet in a single layer or several layers that are attached to a series of lateral braces that are at a common distance from each other in a vertical direction of the doorway, with each end being controlled in a vertical guide profile. An upper edge of the doorway is connected to a hoisting device which includes a hoisting means including lines, belts or chains for attachment to each lateral brace. The hoisting means is connected to a hoisting device so as to have equal pulling velocity and is connected to the lateral braces above the lower one by pulleys that provide a common upper lifting limit for the respective lateral braces and the transfer of loading due to weight to the upper edge of the doorway.

Advantageously, the hoisting means is connected to each lateral brace by pulleys with the free end of the hoisting means being attached at a lateral support above and at the upper edge of the doorway. The hoisting means may be led through an increasing number of pulleys from the lower lateral brace in an upward direction.

The individual hoisting means may, in accordance with the present invention, be led through pulleys and down to a common attachment point on the lower lateral brace.

Advantageously, the hoist line, belt, or chain may be led from an upper winch drum down to each of the lateral braces, with each hoist to a lateral brace above the lowest lateral brace being led through at least one turn pulley more than the hoist to the lateral brace below and the hoist to the lowest lateral brace may be led directly to this lateral brace by a return pulley connected to the upper lateral support.

BRIEF DESCRIPTION OF THE DRAWINGS

The invention will be described in more detail with reference to the accompanying drawings, wherein.

DETAILED DESCRIPTION

Figure 1:
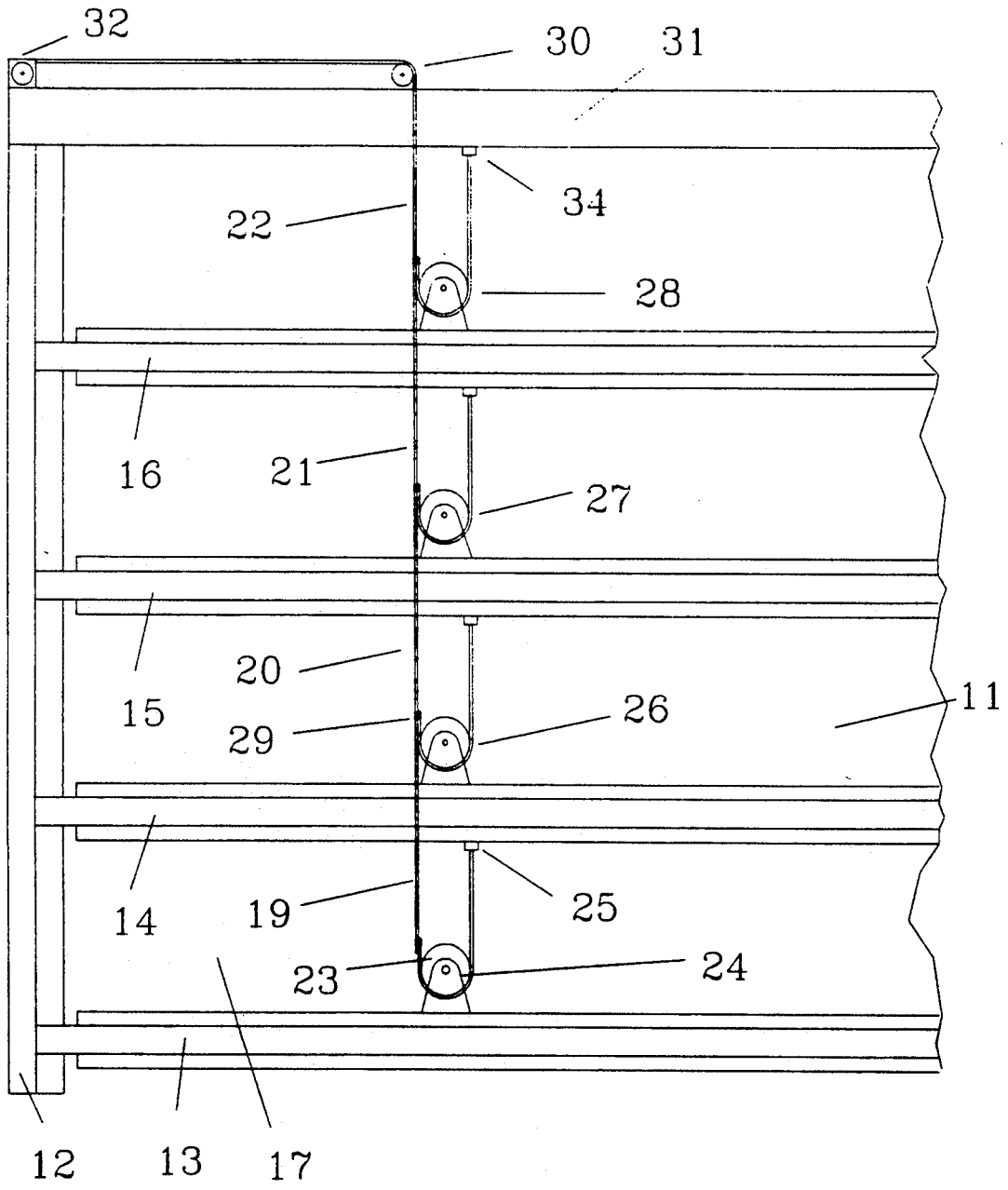
FIG. 1 is a front schematic view of a portion of a door constructed in accordance with the present invention, with the door including four individual sections.

Referring now to the drawings wherein like reference numerals are used throughout the various views to designate like parts and, more particularly, to FIG. 1, according to this figure, a doorleaf 11 is supported by guide profiles 12 disposed adjacent to respective sides thereof, with the guide profiles 12, only one of which is shown in FIG. 1, being statically mounted at the edge of the doorway. The doorleaf 11 in the illustrated example comprises four horizontal beams or lateral braces 13, 14, 15, 16 with the lateral braces 13–16 having pulleys (not shown) fitted at each end that are mated with equivalent grooves (not shown) in the guide profile 12. A fabric 17 is attached on the outside of the lateral braces 13–16, with the fabric 17 being one of a continuous sheet or jointed pieces for each lateral brace. In an equivalent manner, the doorleaf 11 is covered internally by a second fabric 18 (FIG. 2), so that there is a layer of air between the two fabric sheets 17, 18 that can improve the thermal insulation of the door.

The lateral braces 13–16 may, for example, be lattice braces, struts or other forms of support and made of lightweight materials, steel or composites.

Separate hoist belts 19–22 are provided for each lateral base 13–16 and are used to raise the individual lateral braces 13–16. Hoist belt 19 for the lowest lateral brace 13 is attached to the lateral brace by pulley 23 that, in the illustrated example, is located on an upper edge of the lateral brace 13 and mounted with appropriate fittings, such as, for example, a bracket 24. From pulley 23, the hoist belt 19 extends upwardly and is attached to the lower edge of the next lateral brace 14 at an attachment point 25. The top hoist belt 22 is attached at 34 to the upper edge of the doorway.

The other lateral braces have similar pulleys 26–28. The individual hoist belts 19–21 for the three lower lateral braces 13–15 are attached at their free ends to the hoist belt above, respectively, 20–22 on the outside of the pulleys with respect to their respective attachment points. This is illustrated by the attachment point 29, shown in detail in FIG. 4.

The upper hoist belt 22 is led to a pulley 30 on a lateral support 31 above the doorway and from their to a winch 32 on the upper edge of the guide profile 12.

The system with hoists may, in principle, be used as an individual design for smaller doors and in tandem or multiple configurations for wider doors. It is advantageous, but not compulsory, to place a stop on each hoist belt, this will connect the specific hoist when the lateral brace reaches its lowermost position. This will enable the lateral brace to be suspended from the fixed end of each hoist belt which, consequently, avoids transferring loading due to weight of the fabric.

Figure 2:
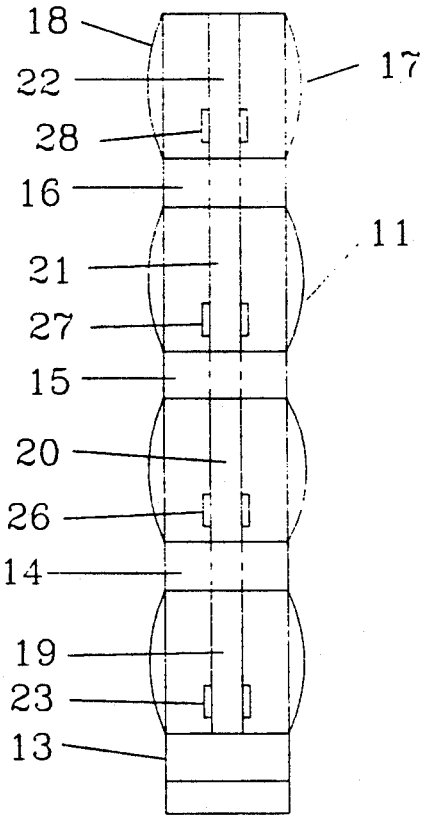
FIG. 2 is a section through a door in FIG. 1, with the door in a closed position.
Figure 3:
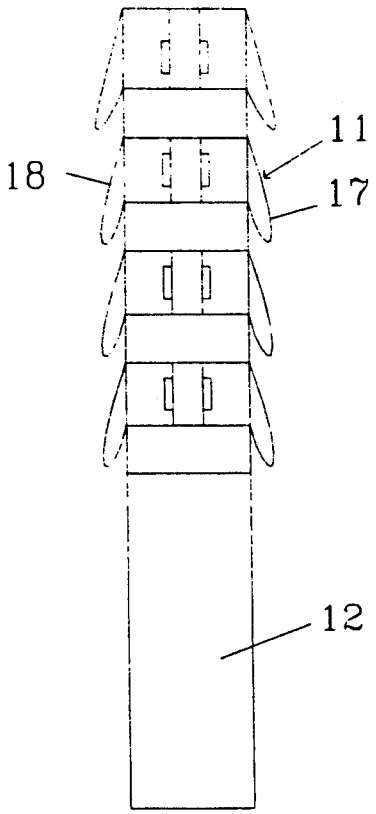
FIG. 3 is a section of the door in FIG. 1 in a partly raised position.

FIGS. 2 and 3 illustrate the manner in which the hoist belts 19–22 are located in the space between the two fabrics 17 and 18 so that they are concealed from sight and any outside interference.

Figure 4:
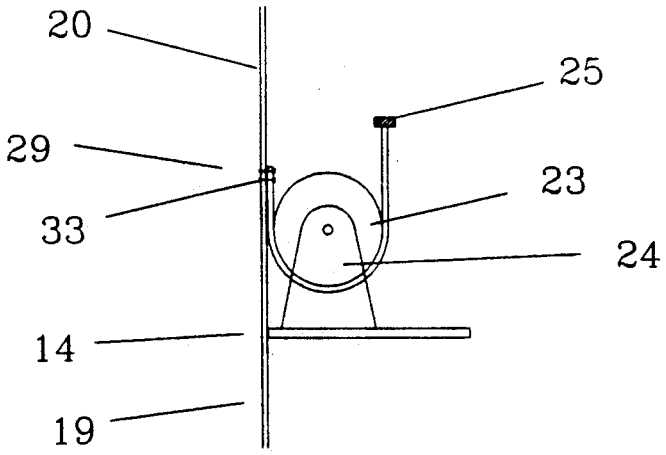
FIG. 4 is a detailed sectional view of the hoisting mechanism.

FIG. 4 illustrates the manner in which the hoist belts 19–22 are joined together by rivets 33 at the attachment points 29.

The above described example can be modified in a number of different ways and, for example, the hoist belts may be replaced by twine, line, a chain or something similar.

The above-described arrangement shown will enable an arbitrarily high door to be raised through winding the hoist unit a distance that is twice the distance of a gap between two lateral braces.

An important advantage of the invention is that the hoisting components can be made of a non-flammable material such as steel wire, which will thereby keep the individual lateral braces in place in case of fire.

The system described above will be unable to fully utilize the lifting height, this is because of the gearing between each lateral brace. An alternative is that the door is built with diminishing distance between the lateral braces from the bottom and upwards. In addition, the winch 32 must be designed to raise half the weight of the door.

Figure 5:
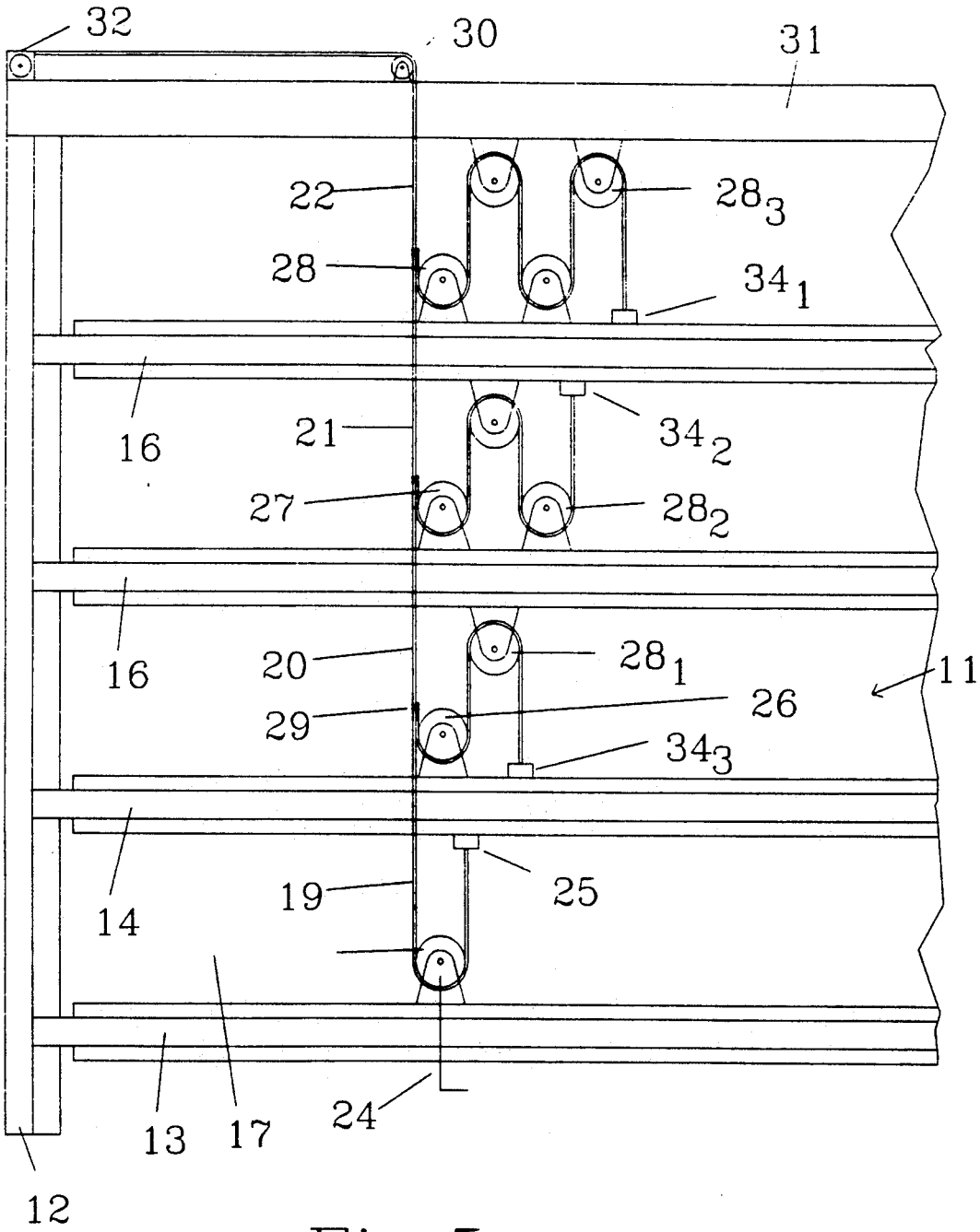
FIGS. 5 and 6 are schematic views of two alternative constructions of the present invention.

In an alternative construction of FIG. 5, above the lower lateral brace 13 there is an in-built reduction gearing between lateral braces 14–15 and 15–16 and between the upper lateral brace 16 and the lateral support 31 above the doorway. This gearing system comprises an increasing number of return pulleys 28, $28_1$, $28_2$, $28_3$, for the hoist wires 20–21. The return pulleys are located alternatively on the lateral braces below and above, respectively, and on the lateral support above the doorway. This design necessitates an insertion or use of a longer length of hoist belt; however, it makes a corresponding reduction in the lifting force necessary. With the insertion of a length of belt that is equal to the height of the doorway plus the distance between neighboring lateral braces, all the lateral braces can be completely raised. If gearing is used, the lifting force can also be reduced so that the winch can be designed accordingly.

Figure 6:
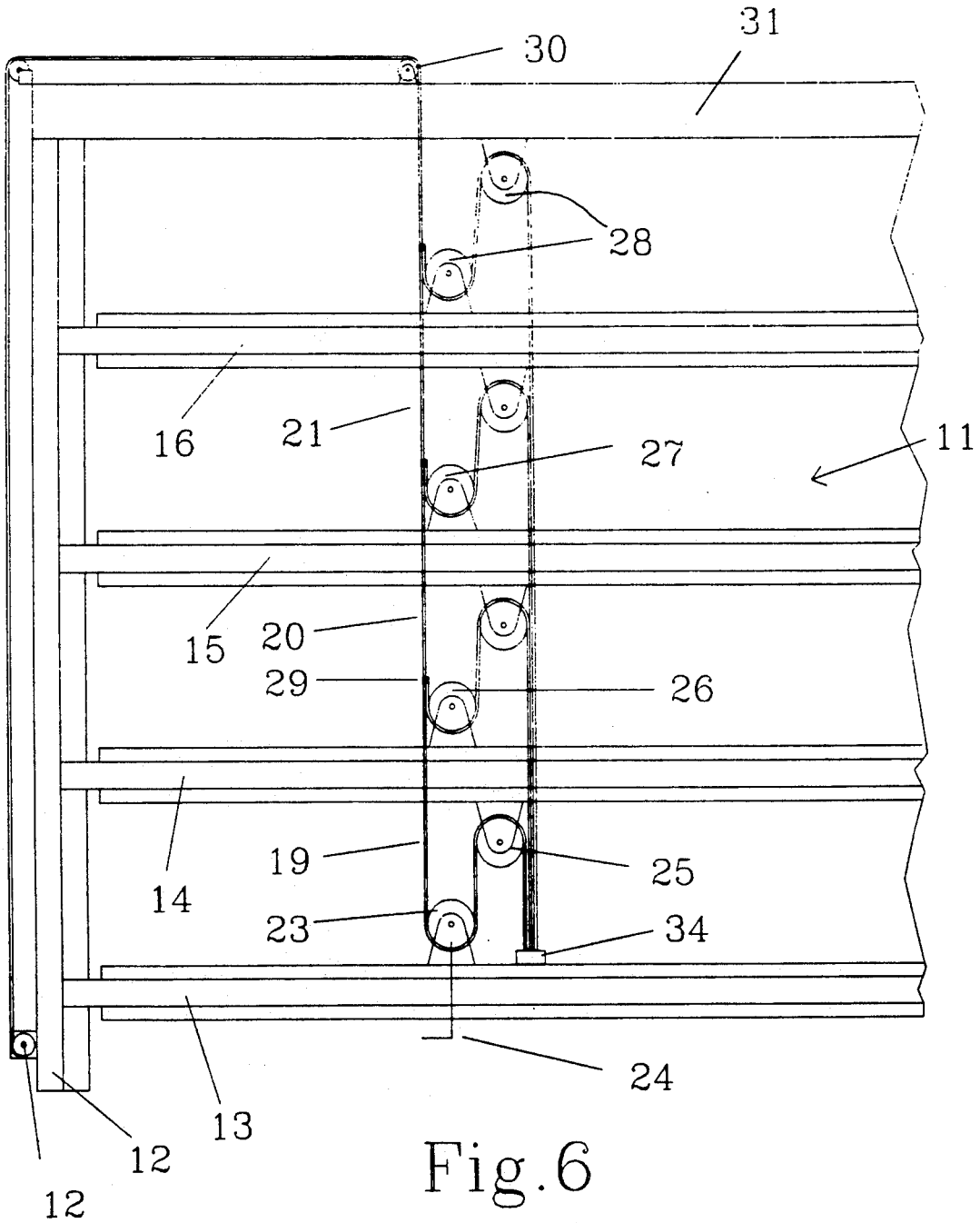

In a further alternative construction of FIG. 6, all the hoist belts 19–22 are, through a return pulley on the upper lateral brace, respectively on the lateral support above the doorway, and from there down to a common attachment point 34 on the lower lateral brace 13. This makes the length of all of the hoist belts 19–22 the same and they can be winched equally and give complete hoisting of all lateral braces. In this example, the winch 32 is placed at the bottom edge of the doorway away from the guide profile 12.

As an alternative to the configuration in FIG. 1, a separate belt can be led from the upper winch drum to each of the lateral braces. This can be done by a hoist belt being led directly to the lower lateral brace and that the hoist to the lateral brace above is led to a further return pulley for each of the lateral braces above, according to the principle illustrated and described in connection with FIG. 5. This design will give even loading on all hoists so that they can have equal dimensions. If the loading on the hoist is to be reduced, a return pulley can be added for each hoist belt.

I claim:

1. A door comprising:

a flexible planar door leaf suspended from an upper edge of a doorway including a continuous sheet in at least one layer attached to a series of lateral braces, said lateral braces being spaced at an equal distance from each other in a vertical direction of the doorway to define a plurality of sections, a vertically extending guide profile provided at respective lateral edges of the doorway for guiding and supporting the door, a plurality of hoisting means respectively attached to the respective lateral braces and to hoisting element so as to have an equal pulling velocity, wherein said plurality of hoisting means are connected to the respective lateral braces by pulleys so as to provide a common upper lifting limit for the respective lateral braces and a transfer of a weight load of the door to an upper edge of the doorway, and wherein the connection of the respective hoisting means to the common hoisting element enables a hoisting of the door between an open and closed position.

2. A door according to claim 1 wherein each hoisting means is attached to lateral brace by said pulleys, and wherein a free end of the hoisting means is attached at a lateral brace above, and, in the case of the upper most section, at an said upper edge of the doorway.

3. A door according to claim 1, wherein each hoisting means is led through an increasing number of said pulleys from a lower lateral brace in a vertical direction.

4. A door according to claim 1, wherein the respective hoisting means are led through said pulleys and down to a common attachment point located on the lower lateral brace.

5. A door according to claim 1, wherein the respective hoisting means each include a hoist belt, said, hoisting element includes an upper winch drum, each hoist belt attached to a lateral brace above the lowest lateral brace of the door is led through at least one said pulley more than the hoist belt to the lateral brace below, and wherein the hoist belt to the lowest lateral brace is lead directly to the lower lateral brace by a pulley connected to the upper lateral support.

* * * * *